US011759676B2

(12) United States Patent
Lee et al.

(10) Patent No.: US 11,759,676 B2
(45) Date of Patent: Sep. 19, 2023

(54) TRAINING APPARATUS FOR IMPROVING CONTROL ABILITY OF LOWER LIMB

(71) Applicant: KOREA INSTITUTE OF SCIENCE AND TECHNOLOGY, Seoul (KR)

(72) Inventors: Song Joo Lee, Seoul (KR); Choong Hyun Kim, Seoul (KR); Inchan Youn, Seoul (KR); Sungmin Han, Seoul (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 17/672,797

(22) Filed: Feb. 16, 2022

(65) Prior Publication Data

US 2022/0258004 A1 Aug. 18, 2022

(30) Foreign Application Priority Data

Feb. 17, 2021 (KR) ..... 10-2021-0021135

(51) Int. Cl.
*A63B 23/10* (2006.01)
*A63B 21/02* (2006.01)
(Continued)

(52) U.S. Cl.
CPC ..... *A63B 23/10* (2013.01); *A63B 21/00069* (2013.01); *A63B 21/015* (2013.01);
(Continued)

(58) Field of Classification Search
CPC ..... A63B 23/03508; A63B 23/0494; A63B 23/08–10; A63B 21/00069;
(Continued)

(56) References Cited

U.S. PATENT DOCUMENTS 2,760,774 A * 8/1956 Perez ..... A63B 21/4015 482/79
4,199,137 A * 4/1980 Giguere ..... A63B 22/18 601/27

(Continued)

FOREIGN PATENT DOCUMENTS

JP 3070503 U 8/2000
JP 3186380 U 10/2013

(Continued)

*Primary Examiner* — Loan B Jimenez
*Assistant Examiner* — Kathleen M Fisk
(74) *Attorney, Agent, or Firm* — NSIP Law

(57) ABSTRACT

The training apparatus according to an embodiment includes: a support unit; a guide unit fixed on the support unit and including rails which extend in a front-rear direction; a sliding unit which is movable in the front-rear direction along the rails of the guide unit; a pillar-shaped rotation axis fixed on the support unit; a footrest unit which supports a user's foot; a lower support formed below the footrest unit; and a connection rotating unit formed below the footrest unit and connected to the rotation axis of the support unit through insertion to allow the footrest unit to rotate around the rotation axis. A plurality of springs installed inward from two sidewalls of the sliding unit is configured to come into contact with the lower support of the footrest unit and apply pressure from two sides when the footrest unit rotates.

9 Claims, 3 Drawing Sheets

(51) Int. Cl.

| | |
|---|---|
| ***A63B 21/00*** | (2006.01) |
| ***A63B 23/035*** | (2006.01) |
| ***A63B 21/05*** | (2006.01) |
| ***A63B 21/04*** | (2006.01) |
| ***A63B 21/015*** | (2006.01) |

(52) U.S. Cl.
CPC ..... *A63B 21/023* (2013.01); *A63B 21/0428* (2013.01); *A63B 21/05* (2013.01); *A63B 21/4034* (2015.10); *A63B 21/4049* (2015.10); *A63B 23/03508* (2013.01)

(58) Field of Classification Search
CPC . A63B 21/015; A63B 21/023; A63B 21/0428; A63B 21/05; A63B 21/4034; A63B 21/4015; A63B 21/00061; A63B 21/02; A63B 21/022; A63B 21/025; A63B 21/026; A63B 21/04; A63B 21/0407; A63B 21/0421–0442; A63B 21/4033; A63B 21/4045–4049; A63B 22/0061; A63B 22/0046; A63B 22/203; A63B 22/0048
See application file for complete search history.

(56) References Cited

U.S. PATENT DOCUMENTS

| | | | | | |
|---|---|---|---|---|---|
| 4,998,720 | A * | 3/1991 | Kim | A63B 22/14 | 482/79 |
| 6,283,897 | B1 * | 9/2001 | Patton | A63B 21/4015 | 482/79 |
| 6,821,235 | B1 * | 11/2004 | Johnson | A63B 21/4015 | 482/79 |
| 7,959,544 | B2 * | 6/2011 | Palmer | A63B 22/0061 | 482/130 |
| 8,202,205 | B2 * | 6/2012 | Reade | A63B 21/0552 | 482/121 |
| 8,206,267 | B2 * | 6/2012 | Holden | A63B 21/4015 | 482/4 |
| 8,795,139 | B2 * | 8/2014 | Zhang | A63B 71/0054 | 482/52 |
| 2014/0057758 | A1 * | 2/2014 | Mack | A63B 21/0428 | 482/79 |

FOREIGN PATENT DOCUMENTS

| | | | |
|---|---|---|---|
| JP | 3229460 | U | 12/2020 |
| KR | 10-2008-0099405 | A | 11/2008 |
| KR | 10-2013-0134749 | A | 12/2013 |
| KR | 10-1540699 | | 8/2015 |
| KR | 10-1893915 | B1 | 9/2018 |

* cited by examiner

TRAINING APPARATUS FOR IMPROVING CONTROL ABILITY OF LOWER LIMB

DESCRIPTION OF GOVERNMENT-FUNDED RESEARCH AND DEVELOPMENT

This research is conducted by Korea Institute of Science and Technology under the support of interagency full cycle medical device research and development program of Ministry of Health and Welfare (Commercialization of age friendly lower limb musculoskeletal multidirectional biofeedback rehabilitation exercise systems for aging-in-place, Project serial number: 202013606-03).

CROSS-REFERENCE TO RELATED APPLICATION

This application claims priority to Korean Patent Application No. 10-2021-0021135, filed on Feb. 17, 2021, and all the benefits accruing therefrom under 35 U.S.C. § 119, the contents of which in its entirety are herein incorporated by reference.

BACKGROUND OF THE INVENTION

Field of the Invention

The present disclosure relates to a training apparatus for improving lower limb control ability, and more particularly, to a training apparatus for assisting to train the lower limb muscles and improve the lower limb control ability, the training apparatus including a footrest which rotates around a rotation axis by a user's lower limb movement and springs which apply a load to the rotation of the footrest.

Description of the Related Art

Recently, as population ageing is more advanced, the number of patients with sarcopenia or degenerative arthritis of knees is growing fast. The losses of lower limb muscles or degenerative diseases lead to poorer physical function, causing fall injuries or secondary diseases, and as a result, significantly threatening the health of old people. To prevent this, it is important to maintain and improve the lower limb nerve and muscle control ability through continuous exercise, but most of lower limb exercise methods or exercise tools only assist to repeatedly walk or adjust the walking speed, and there are not many methods for training the lower limb muscles and nerves or improving balance according to the rotation direction. The repeated exercises of specific motions such as walking or running motions have risks of degeneration of muscles or motor nerves not used usually and severe injuries in unexpected situations, for example, slipping on icy roads.

Meanwhile, patients with neurological diseases include stroke, cerebral palsy, spinal cord paralysis and multiple sclerosis or patients with musculoskeletal injuries including ligament and cartilage damage have many difficulties in making rotational movements. However, since most of rehabilitation exercise tools also focus only on walking assistance, patients who have difficulties in making rotational movements, for example, patients with cerebral palsy need rehabilitation training for controlling the lower limbs in a specific direction such as out-toeing training, but effective rehabilitation training methods or tools are scarce.

Related Literatures (Patent Literature 1) Korean Patent No. 10-1893915

SUMMARY OF THE INVENTION

The present disclosure is directed to providing a training apparatus for effectively improving the lower limb control ability to move the lower limb in a specific direction or maintain balance.

A training apparatus for improving lower limb control ability according to an embodiment of the present disclosure includes: a support unit fixed to a ground or an exercise tool to support the entire apparatus; a guide unit fixed on the support unit, the guide unit including rails which extend in a front-rear direction; a sliding unit which is movable in the front-rear direction along the rails of the guide unit; a pillar-shaped rotation axis fixed on the support unit; a footrest unit which supports a user's foot; a lower support formed along a center of the foot below a region of the footrest unit corresponding to a forefoot and a midfoot; and a connection rotating unit formed below a region of the footrest unit corresponding to a rearfoot, and connected to the rotation axis of the support unit through insertion to allow the footrest unit to rotate around the rotation axis, wherein a plurality of springs installed inward from two sidewalls of the sliding unit is configured to come into contact with the lower support of the footrest unit and apply pressure from two sides when the footrest unit rotates.

According to an embodiment, the training apparatus for improving lower limb control ability may further include a pillar-shaped motion range adjusting unit installed on two sides of the support unit, wherein the motion range adjusting unit is configured to limit a rotation range by preventing the footrest unit from rotating a predetermined angle or more.

According to an embodiment, a distance between the two pillars of the motion range adjusting unit may be adjustable to arbitrarily adjust the rotation range of the footrest unit.

According to an embodiment, the connection rotating unit may include a component which fixes the inserted rotation axis at a predetermined location and assists the footrest unit to rotate around the axis while supporting a load applied to the axis.

According to an embodiment, the connection rotating unit may be connected to a bearing or a damper and configured to adjust an exercise intensity and a degree of friction of the footrest.

According to an embodiment, the plurality of springs installed in the sliding unit may have different elastic moduli to differently set a magnitude of applied pressure depending on a rotation direction of the footrest unit.

According to an embodiment, the elastic modulus of each of the plurality of springs may be set to increase an intensity of stimulation in a lower limb muscle part that the user intends to train by setting up or down a resistance to rotation in a specific direction depending on the lower limb muscle part.

According to an embodiment, the training apparatus may be configured to adjust a training load by adjusting a distance from a center of the rotation axis to a contact point between the plurality of springs and the lower support.

According to an embodiment, the support unit may be installed on a stepper which allows the user to repeat a walking motion in place.

The training apparatus according to an embodiment of the present disclosure includes the footrest which rotates by a user's lower limb movement and the springs which apply a load to the rotation of the footrest. By the springs, the user feels resistance to a motion of rotating or maintaining the lower limb, and can develop the muscles and nerves related to the rotation of the lower limb through the repeated training motions. According to an embodiment, the elastic modulus of each spring may be differently set to increase or decrease the resistance to a specific direction, and through this, it is possible to selectively train the muscles and nerves involved in the rotation in the specific direction. The training apparatus according to an embodiment does not need an additional component, for example, a motor, and thus it is possible to reduce the production and maintenance costs and install without spatial limitations.

BRIEF DESCRIPTION OF THE DRAWINGS

The following is a brief introduction to necessary drawings in the description of the embodiments to describe the technical solutions of the embodiments of the present disclosure or the existing technology more clearly. It should be understood that the accompanying drawings are for the purpose of describing the embodiments of the present disclosure and are not intended to be limiting of the present disclosure. Additionally, for clarity of description, illustration of some elements in the accompanying drawings may be exaggerated and omitted.

DETAILED DESCRIPTION OF THE PREFERRED EMBODIMENTS

Figure 1:
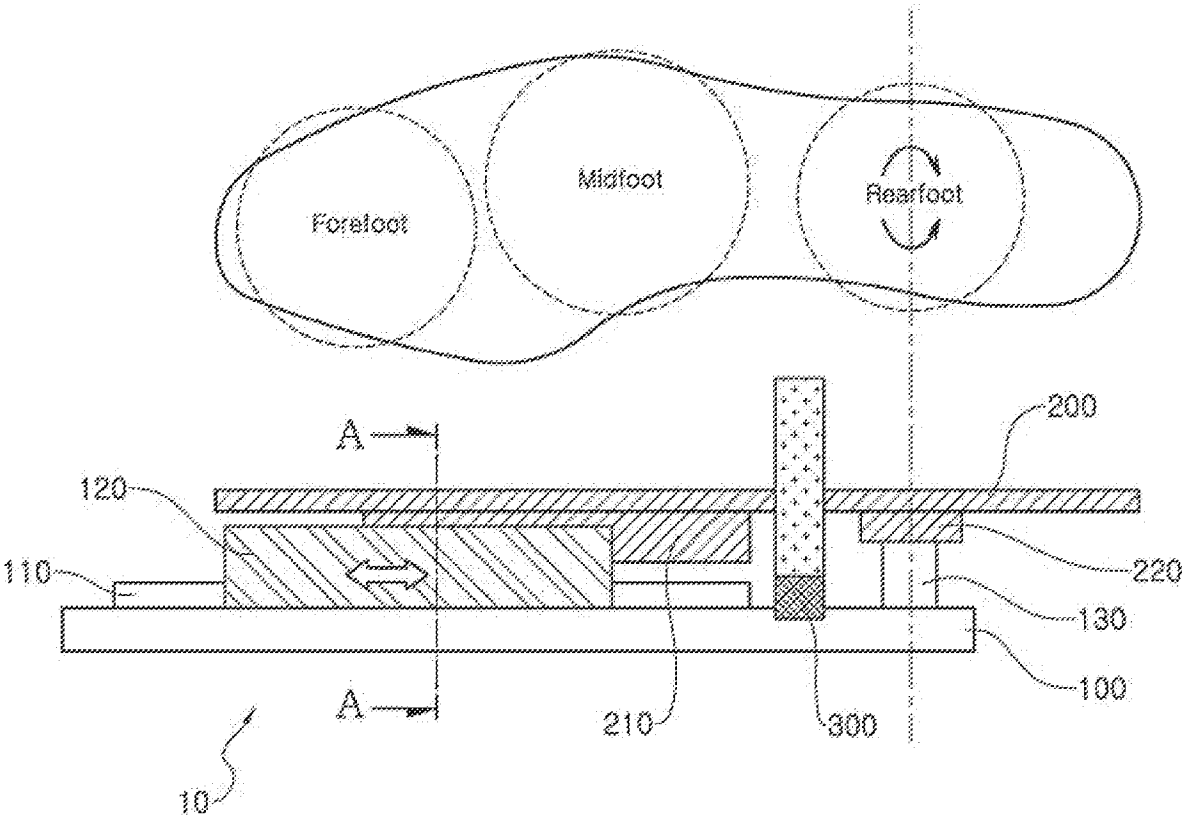
FIG. 1 is a side view showing the structure of a training apparatus for improving lower limb control ability according to an embodiment.

The following detailed description of the present disclosure is made with reference to the accompanying drawings, in which particular embodiments for practicing the present disclosure are shown for illustration purposes. These embodiments are described in sufficiently detail for those skilled in the art to practice the present disclosure. It should be understood that various embodiments of the present disclosure are different but do not need to be mutually exclusive. For example, particular shapes, structures and features described herein in connection with one embodiment may be embodied in other embodiment without departing from the spirit and scope of the present disclosure. It should be further understood that changes may be made to the positions or placement of individual elements in each disclosed embodiment without departing from the spirit and scope of the present disclosure. Accordingly, the following detailed description is not intended to be taken in limiting senses, and the scope of the present disclosure is only defined by the appended claims along with the full scope of equivalents to which such claims are entitled. In the drawings, similar reference signs denote same or similar functions in many aspects.

The terms as used herein are general terms selected as those being now used as widely as possible in consideration of functions, but they may differ depending on the intention of those skilled in the art or the convention or the emergence of new technology. Additionally, in certain cases, there may be terms arbitrarily selected by the applicant, and in this case, the meaning will be described in the corresponding description part of the specification. Accordingly, it should be noted that the terms as used herein should be interpreted based on the substantial meaning of the terms and the context throughout the specification, rather than simply the name of the terms.

Hereinafter, the components of a training apparatus will be described in detail with reference to FIGS. 1 and 2.

Figure 2:
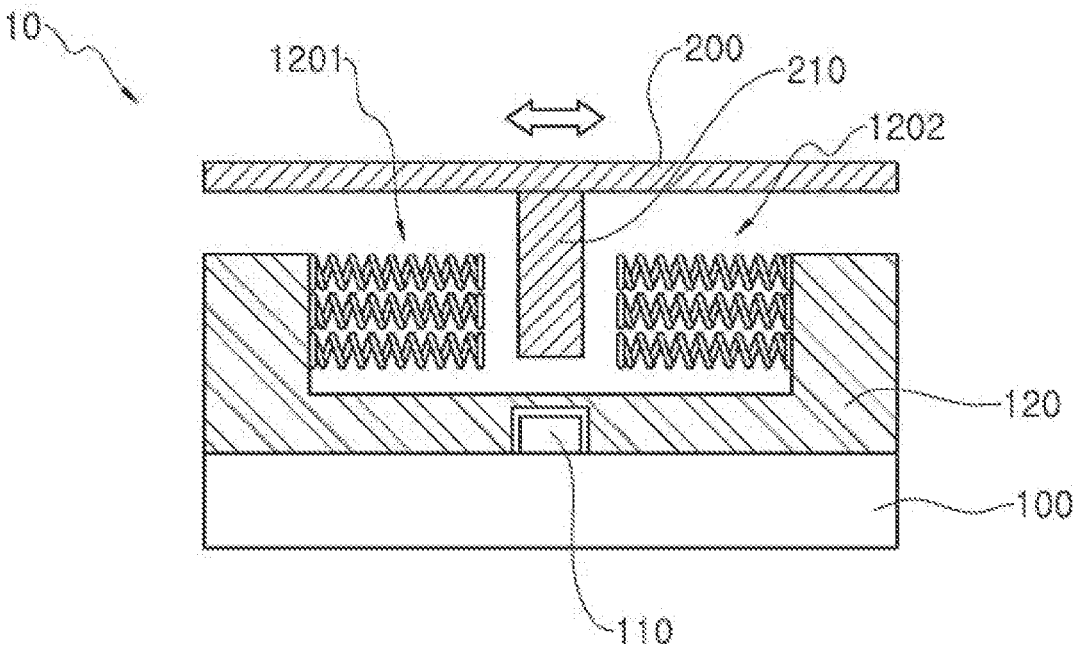
FIG. 2 is a cross-sectional view showing the structure of a training apparatus for improving lower limb control ability according to an embodiment.

FIG. 1 shows the side structure of a training apparatus for improving lower limb control ability according to an embodiment. FIG. 2 shows the structure of the training apparatus of FIG. 1, taken along the line A-A. Here, the apparatus shown in FIGS. 1 and 2 corresponds to a foot (a right foot). Accordingly, a pair of apparatuses is necessary for both feet.

Referring to FIG. 1, the training apparatus 10 according to an embodiment includes a support unit 100, a guide unit 110, a sliding unit 120, a rotation axis 130, a footrest unit 200, a lower support 210, a rotating connector 220 and a pillar-shaped motion range adjusting unit comprising two pillars 300.

The support unit 100 is disposed at the lowermost end of the training apparatus 10 and serves to support the entire training apparatus 10. The support unit 100 may be installed not only on the ground but also in an exercise tool (for example, a pedal of a stepper which assists a user to repeat a walking motion in place). According to an embodiment, a nonslip pad may be provided to firmly fix by increasing the frictional force with the ground or the exercise tool. In addition, the support unit 100 may be made in the shape of a flat plate, but is not limited to a specific shape.

The guide unit 110 is fixed on the support unit 100 and guides the movement of the sliding unit 120 through rails which extend in the front-rear direction (the direction of arrow in FIG. 1).

The sliding unit 120 is configured to move in the front-rear direction (the direction of arrow in FIG. 1) along the rails of the guide unit 110. Referring to FIG. 2, a plurality of springs 1201, 1202 installed facing inward is on the sidewalls disposed at two ends of the support unit 100 in the structure of the sliding unit 120. When the lower support 210 disposed below the footrest unit 200 moves in the left-right direction (the direction of arrow in FIG. 2), the springs come into contact with the lower support 210 and apply pressure.

The footrest unit 200 is a component for allowing the user to stand on his/her foot and may be made to conform to the shape of the sole. According to an embodiment, Velcro may be additionally provided to firmly fix the user's lower limb and the footrest.

Referring to FIG. 1, on the bottom of the footrest unit 200, the lower support 210 is disposed along the center of the foot below the region corresponding to the forefoot and the midfoot, and the rotating connector 220 is disposed below the region corresponding to the rearfoot.

When the user places his/her foot on the footrest unit 200 and moves left and right, the lower support 210 rotates left and right around the rotation axis, and presses down the springs installed on the sidewalls of the sliding unit 120. Accordingly, the user can train the lower limb muscles and nerves by repeating the motion against the resistance from the direction that the user intends to rotate.

The rotating connector 220 is a component which directly connects the support unit 100 to the footrest unit 200. The pillar-shaped rotation axis 130 fixed on the rear side of the support unit 100 is connected to the rotating connector 220 through insertion, and is an axis of rotation when the footrest unit 200 moves in the left-right direction. According to an embodiment, the rotating connector 220 includes a component which fixes the inserted rotation axis 130 at a predetermined location, and assists the footrest unit 200 to rotate around the axis while supporting the load applied to the axis. For example, the rotating connector 220 may be connected to a bearing or a damper to adjust the exercise intensity and the degree of friction of the footrest.

According to an embodiment, the training apparatus 10 may further include a pillar-shaped motion range adjusting unit comprising two pillars 300 installed on two sides of the support unit 100. The pillar-shaped motion range adjusting unit comprising two pillars 300 serves to limit the rotation range by preventing the footrest unit 200 from rotating a predetermined angle or more.

Figure 3:
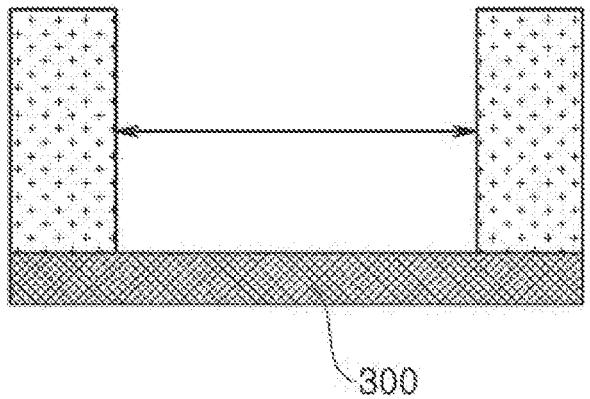
FIG. 3 is a cross-sectional view showing the structure of a pillar-shaped motion range adjusting unit comprising two pillars according to an embodiment.

FIG. 3 is a cross-sectional view showing the structure of the motion range adjusting unit according to an embodiment. The distance between the two pillars of the motion range adjusting unit 300 is adjustable to arbitrarily adjust the rotation range of the footrest unit. For example, when a smaller distance between the pillars is set, the motion range of the footrest unit may be narrower, and when a larger distance between the pillars is set, the motion range of the footrest unit may be wider.

Hereinafter, a training method for improving the user's lower limb control ability using the training apparatus of the above-described embodiment will be described.

According to an embodiment, the plurality of springs 1201, 1202 installed in the sliding unit 120 has different elastic moduli to differently set the magnitude of the applied pressure according to the rotation direction of the footrest unit 200 and the lower support 210. For example, when a patient with cerebral palsy does out-toeing training (training to point two feet outward), in case that a spring having low elastic modulus is used for the spring 1201 which resists in-toeing rotation, and a spring having high elastic modulus is used for the spring 1202 which resists out-toeing rotation, a stronger resistance is exerted when turning the foot outward than pointing the foot inward. In this condition, it is possible to train the muscles and nerves necessary for outward rotation by repeating the motion of rotating or maintaining the lower limb in the outward direction in which resistance is strong.

On the contrary, increasing the elastic modulus of the spring 1201 which resists in-toeing rotation and decreasing the elastic modulus of the spring 1202 which resists out-toeing rotation makes it more difficult to point the foot inward. In this condition, it is possible to train the muscles and nerves necessary for inward rotation by repeating the motion of rotating or maintaining the lower limb in the inward direction in which resistance is strong.

As described above, it is possible to selectively increase the intensity of stimulation in the specific part by setting up or down the resistance to the specific directional rotation depending on the lower limb muscle part that the user intends to train.

According to an embodiment, to decrease or increase the resistance to rotation, for example, a hydraulic device may be used instead of the spring. In particular, when an electronic hydraulic device is used, it is possible to adjust the magnitude of the pressure applied to the footrest unit and the lower support for each region without needing to replace the spring, and thus it can be applied to a variety of training programs.

The sliding unit 120 may move in the front-rear direction along the guide unit 110, and when the sliding unit is moved forward (the left direction in FIG. 1) or away from the guide unit, the footrest unit 200 is not supported by the two springs any longer and is only supported by the connection of the rotation axis 130 and the rotating connector 220. Accordingly, when the lower limb makes even a small movement, the footrest unit 200 rotates around the rotation axis 130 to a large extent, and thus it is possible to train balance through the motion of keeping the footrest immobile and improve the lower limb control ability.

According to an embodiment, it is possible to adjust the training load by adjusting the distance from the center of the rotation axis 130 to the contact point between the plurality of springs 1201, 1202 and the lower support 210.

According to the embodiments described above, it is possible to selectively apply a load to the rotational movement of the lower limb using the springs (or the hydraulic device), and through this, develop the muscles and nerves related to the rotation of the lower limb. According to an embodiment, it is possible to selectively train the muscles and nerves necessary for rotation or maintenance in a specific direction by setting up or down the resistance to the specific direction. The training apparatus according to an embodiment does not need an additional component, for example, a motor, and thus it is possible to reduce the production and maintenance costs and install without spatial limitations.

While the present disclosure has been hereinabove described with reference to the embodiments, those skilled in the art will understand that various modifications and changes may be made thereto without departing from the spirit and scope of the present disclosure defined in the appended claims.

What is claimed is:

1. A training apparatus for improving lower limb control ability, comprising:

a support unit fixed to a ground or an exercise tool to support the entire apparatus;

a guide unit fixed on the support unit, the guide unit including rails which extend in a front-rear direction;

a sliding unit which is movable in the front-rear direction along the rails of the guide unit;

a pillar-shaped rotation axis fixed on the support unit;

a footrest unit which supports a user's foot;

a lower support formed beneath an area of the footrest unit corresponding to a forefoot and a midfoot along a center of the footrest unit; and a rotating connector formed below a region of the footrest unit corresponding to a rearfoot, and connected to the rotation axis of the support unit through insertion to allow the footrest unit to rotate around the rotation axis, wherein a plurality of springs installed inward from two sidewalls of the sliding unit is configured to come into contact with the lower support of the footrest unit and apply pressure from two sides when the footrest unit rotates.

2. The training apparatus for improving lower limb control ability according to claim 1, further comprising:

a pillar-shaped motion range adjusting unit comprising two pillars installed on two sides of the support unit, wherein the pillar-shaped motion range adjusting unit comprising two pillars is configured to limit a rotation range by preventing the footrest unit from rotating a predetermined angle or more.

3. The training apparatus for improving lower limb control ability according to claim 2, wherein a distance between the two pillars of the pillar-shaped motion range adjusting unit comprising two pillars is adjustable to arbitrarily adjust the rotation range of the footrest unit.

4. The training apparatus for improving lower limb control ability according to claim 1, wherein the plurality of springs installed in the sliding unit has different elastic moduli to differently set a magnitude of applied pressure depending on a rotation direction of the footrest unit.

5. The training apparatus for improving lower limb control ability according to claim 4, wherein an elastic modulus of each of the plurality of springs is set to increase an intensity of stimulation in a lower limb muscle part that the user intends to train by setting up or down a resistance to rotation in a specific direction depending on the lower limb muscle part.

6. The training apparatus for improving lower limb control ability according to claim 1, wherein the rotating connector is connected to a bearing or damper to hold the inserted rotation axis in a predetermined position and support the footrest unit to rotate around the axis while supporting a load applied to the axis.

7. The training apparatus for improving lower limb control ability according to claim 1, wherein the rotating connector is connected to a bearing or a damper to adjust an exercise intensity and a degree of friction of the footrest unit.

8. The training apparatus for improving lower limb control ability according to claim 1, wherein the training apparatus is configured to adjust a training load by adjusting a distance from a center of the rotation axis to a contact point between the plurality of springs and the lower support.

9. The training apparatus for improving lower limb control ability according to claim 1, wherein the support unit is installed on a stepper which allows the user to repeat a walking motion in place.

* * * * *